US006042340A

United States Patent [19]

Melbourne

[11] Patent Number: 6,042,340

[45] Date of Patent: Mar. 28, 2000

[54] RADIALLY INCLINED PASSAGES FOR INCREASED MIXING IN A FLUID HANDLING DEVICE

[76] Inventor: John Stanley Melbourne, 10 Dellas Avenue, Templestowe Victoria 3106, Australia

[21] Appl. No.: 08/907,730

[22] Filed: Aug. 8, 1997

[30] Foreign Application Priority Data

Aug. 9, 1996 [AU] Australia ..... PO 1509

[51] Int. Cl.[7] ..... F04F 5/00

[52] U.S. Cl. ..... 417/151; 417/163; 417/170; 417/197

[58] Field of Search ..... 417/151, 163, 417/170, 196, 197

[56] References Cited

U.S. PATENT DOCUMENTS

| | | | |
|---|---|---|---|
| 2,444,615 | 7/1948 | Reinhardt | 417/170 |
| 2,968,164 | 1/1961 | Hanson . | |
| 3,964,682 | 6/1976 | Tropeano et al. . | |
| 3,979,061 | 9/1976 | Kircher . | |
| 4,004,732 | 1/1977 | Hanson . | |
| 4,101,073 | 7/1978 | Curran . | |
| 4,105,161 | 8/1978 | Kircher et al. . | |
| 4,488,407 | 12/1984 | Delano . | |
| 4,634,050 | 1/1987 | Shippee . | |
| 4,647,212 | 3/1987 | Hankison . | |
| 5,173,030 | 12/1992 | Heimhard et al. | 417/179 |
| 5,322,218 | 6/1994 | Melbourne | 239/2.2 |

FOREIGN PATENT DOCUMENTS

| | | | |
|---|---|---|---|
| 23070 | 6/1972 | Australia | 417/170 |
| 37279/89 | 3/1990 | Australia . | |
| 57819/90 | 1/1991 | Australia . | |
| 76011/91 | 5/1992 | Australia . | |
| 178 873 | 4/1986 | European Pat. Off. . | |
| 545.629 | 10/1922 | France . | |
| 25 41 439 | 2/1977 | Germany . | |
| 94 20 791 | 9/1996 | Germany | 417/163 |
| 61-275599 | 12/1986 | Japan . | |
| 201884 | 1/1986 | New Zealand . | |
| 239668 | 6/1993 | New Zealand | 239/2.2 |
| 615 484 | 1/1980 | Switzerland | 417/163 |
| 1317-249 | 6/1987 | U.S.S.R. . | |

OTHER PUBLICATIONS

Karassik, Igor J., William C. Krutzsch, Warren H. Fraser and Joseph P. Messina, *Pump Handbook,* McGraw–Hill Book Company, Feb. 16, 1997.

*Primary Examiner*—Charles G. Freay
*Assistant Examiner*—Cheryl J. Tyler
*Attorney, Agent, or Firm*—Merchant & Gould P.C.

[57] ABSTRACT

An fluid handling device (10) having an elongate tubular body which defines a through bore (20) between an inlet end (13) and an outlet end (14) of the body. The device also includes first and second annular chambers (30,38), each of which extends substantially concentrically around the bore (20), the first chamber (30) being in communication with the bore (20) via a first set of passages (48) spaced circumferentially around the bore (20), and the second chamber (38) being in communication with the bore (20) via a second set of passages (49) spaced circumferentially around the bore (20). The passages (48,49) of each set communicate with the bore (20) at a respective axial location (45,46) intermediate the ends (13,14) of the bore (20), with the location (46) for the second set (49) being between the location (45) for the first set (48) and the outlet end (14) of the housing, and each passage of each set (48,49) having an opening into the bore (20) which faces towards the outlet end (14) of the body. The device (10) also includes a first inlet port (42) by which the first chamber (30) is connectable to a source of pressurized fluid, and a second inlet port (44) by which the second chamber (38) is connectable to a source of pressurized fluid. The passages (48,49) of each set are inclined radially towards the axis A of the bore (20) along respective lines such that the lines for passages of the first set (48) converge along the bore (20) to a first region X towards, at or beyond the outlet end (14), and the lines for passages of the second set (49) converge to a second region Y beyond the first region X.

15 Claims, 7 Drawing Sheets

RADIALLY INCLINED PASSAGES FOR INCREASED MIXING IN A FLUID HANDLING DEVICE

FIELD OF THE INVENTION

This invention relates to an improved pumping or mixing device in the form of a pneumatic and/or hydraulic pumping and/or mixing device.

The device has a wide range of uses that may include mixing, pumping, scrubbing or suction operations, all in relation to fluids such as liquids and gases and whether or not the fluids contain particulate matter. Indeed, the operations may extend to the handling of slurries.

Therefore, and due to the wide range of possible uses for the device of the invention, the device will hereinafter be referred to as a fluid handling device

BACKGROUND OF THE INVENTION

One form of pneumatic device, referred to as either an air mover or air pump, has an elongate tubular body defining a through bore. Between the ends of the bore, the body, or a fitting secured thereto, defines an annular chamber that extends substantially concentrically around the bore. Pressurised air is able to be supplied to the chamber for discharge via a plurality of passages, thus providing communication between the chamber and the bore; the passages opening towards one end of the bore such that the discharged air issues from that end. The pressurised air generates a reduction in pressure upstream of the bore from the passages, such that air can be drawn along the bore.

The device functions either as an air mover or an air pump and can be used, for example, for; vacuum generation; to transport particulate material; or to purge gases from, or to supply gas to, an enclosure or work area. Typically, the passages providing communication between the chamber and bore extend substantially parallel to the axis of the bore, or they are inclined toward the bore so as to converge at an axial location downstream of the chamber.

An improved form of pneumatic device of that type is disclosed in my Australian patent 607079. A pump device having some similarity to such pneumatic devices, and suitable for pumping a range of materials, is disclosed in my Australian patent 627043. Also, a somewhat related apparatus for making snow is disclosed in my Australian patent specification 625655. The present invention is concerned with a further development in the context of these devices, and is suitable for use as a pump and/or mixing device.

SUMMARY OF THE INVENTION

According to the invention there is provided a fluid handling device, the device having:

an elongate tubular body which defines a through bore between an inlet and an outlet end of the body;

first and second annular chambers, each of which extends substantially concentrically around the bore, the first chamber being in communication with the bore via a first set of passages spaced circumferentially around the bore, and the second chamber being in communication with the bore via a second set of passages spaced circumferentially around the bore, the passages of each set communicating with the bore at a respective axial location intermediate the ends of the bore, with the location for the second set between the location for the first set and the outlet end of the housing, and each passage of each set having an opening into the bore which faces towards the outlet end of the housing;

a first inlet port by which the first chamber is connectable to a source of pressurised fluid; and a second inlet port by which the second chamber is connectable to a source of pressurised fluid;

wherein the passages of each set are inclined radially towards the axis of the bore along respective lines such that the lines for passages of the first set converge along the bore to a first region towards, at or beyond the outlet end, and the lines for passages of the second set converge to a second region beyond the first region.

GENERAL DESCRIPTION OF THE INVENTION

The device may include at least one additional annular chamber, and thus in a preferred form includes a third annular chamber that extends substantially concentrically around the bore. The third chamber also is in communication with the bore via a third set of passages spaced circumferentially around the bore at a location between the location for the second set and the outlet end of the bore. Each passage of the third set has an opening into the bore that faces towards the outlet end. In that form, the device includes a third inlet port by which the third chamber is connectable to a source of pressurised fluid, while the passages of the third set are inclined radially towards the axis of the bore along respective lines which converge along the bore to a third region beyond the second region.

The invention also provides a process for interacting fluid from at least two pressured fluid streams, using a device according to the invention, wherein each stream is supplied to the inlet port of a respective chamber of the device so as to flow around the chamber and to pass therefrom, via the passages of the chamber, as a plurality of jets passing into the bore of the device towards the outlet end, whereby intimate mixing between the fluid of each stream is achieved in and/or beyond the outlet end of the bore.

In the process, the interaction may comprise mixing between the fluid of each stream, such as to provide blending of two different liquids. For example, different grades of oil or other petroleum product can be efficiently blended. Alternatively, two different liquids can be mixed to achieve a reaction therebetween, such as between two polymer forming liquids. However, a wide variety of other reactions between liquids are possible, or between one liquid and particulate material entrained in the other.

In a further form, two different liquids that are immiscible can be blended to achieve a stable emulsion, such as of oil and water. Again, with two or more liquids, they can be blended with interaction with air or other gas drawn into the bore at the inlet end, while the gas can contain entrained solids which are to be mixed or interacted with the liquids.

Also, in the process of the invention one or more of the fluids can be a gas. In this case, the range of possibilities can be as in the last preceding paragraph herein.

Depending on the form of interaction required between the fluids the passages for all chambers may be without transverse inclination. Alternatively, the passages of at least one of the chambers may have transverse inclination, whether this is in a common direction or opposite directions for two or more chambers. Transverse inclination, whether for the passages of only one or more than one chamber, has the result of generating a substantial level of shear forces in the resultant fluid mixture, enhancing interaction. However, with some fluids such as liquids containing long chain molecules, shear may be a disadvantage, at least if excessive, as it can result in rupturing of such chains where this is not required. However, for shear, a difference in transverse inclination of the passages of two chambers is necessary.

At least to the extent that shear forces can be tolerated, they are highly beneficial in achieving efficient interaction in the mixed fluid. A significant level of shear force, if any, is not able to be generated with a device such as disclosed in Australian patent 607079, despite the transverse inclination of the passages of the single chamber, or in the devices of either of Australian patents 627043 or 625655. However, even without relative transverse inclination able to generate shear forces, the interaction of the two or more fluid steams from two or more chambers provides for substantially enhanced interaction relative to use with a single chamber.

The chambers may be longitudinally adjacent. Thus, where there are two or three chambers, each of these may be longitudinally bracketed together. However where there are two chambers, they may be longitudinally spaced by a conduit which provides a continuation of the bore between the chambers. Where there are three chambers, two may be longitudinally adjacent, with the other one spaced from the two by such conduit, or all three may be longitudinally spaced with a respective such conduit provided between the second chamber and each of the first and third chambers.

With respect to the longitudinal spacing between chambers, or more particularly the longitudinal spacing between axial locations of sets of passages, it has been found that a spacing of up to about seven times the diameter of the bore is beneficial. However, spacing in the range of from two to five times the diameter of the bore may be particularly preferred in certain circumstances. It will be appreciated that different fluids and mixing requirements will significantly alter the preferred spacing distance. Ultimately, the required distance will be determined by reference to whether the mixing has been conducted to acceptable or required levels.

The first and second ports and, where a third chamber is provided, the third port, may be connectable to a respective source of pressurised fluid. Alternatively, the first and second ports may be interconnected by a conduit to enable each to be connectable to a common source of pressurised fluid. In further alternatives in which the third chamber is provided, at least two of the inlet ports may be interconnected by a conduit to enable them to be connected to a common source of pressurised fluid.

Where the fluid supplied to two or each of the chambers is not from a common source, the fluid for each may be the same or different, while the supply pressure can be the same or different. Also, depending on the application, the device may be operated with at least one fluid comprising a liquid or a gas, or at least one fluid comprising a liquid and at least one comprising a gas.

The device can be used to achieve intimate mixing of the fluids. Such mixing may be required simply to blend the fluids or to achieve a reaction between fluids. In the case of blending, the purpose can for example be to achieve an emulsion in which one of two mutually immiscible liquids is dispersed in the other. In the case of liquids to react, the purpose can be for example to provide contact between liquid components that are to react to form a polymer or resin.

For such mixing, to blend or react fluids, the lines for the passages of each set most preferably converge or come close to converging, at the bore axis. For this, each line may be in a respective radial plane through that axis in that the lines converge radially towards the axis and are not also inclined transversely with respect to the axis. However, in at least some applications, the lines for the passages for at least one chamber may also be transversely inclined with respect to the axis but, if so, this usually is at a lesser angle than the radial convergence. The radial and any transverse inclination may apply separately to the lines for the passages of each set of passages, subject to the requirement for the region of convergence for the lines of the second and any third set being beyond respectively that for the first and second set, in a direction towards or beyond the outlet and of the bore. However, it is preferred that the passages in a given set have lines that are similarly inclined, at least in radial inclination but most preferably in any transverse inclination. Also, where there is transverse inclination for the lines of the passages of a given set, this most preferably is in the same direction, although the direction in one set relative to another set may be the same or different.

Again in the case of each fluid being a liquid, the device can be used for mixing the liquids, or to form a reaction product produced by the liquids, with a flowable material received in the bore via the inlet end. Thus, where for example, the liquids react to form a polymer or resin, particulate material such as polymer or resin beads, mineral fines or powder, or radioactive particulate material, can be entrained in a carrier fluid, preferably a carrier gas, and drawn into the bore via the inlet end so as to become encapsulated in polymer or resin produced by the first and second liquids. In this regard, it is to be appreciated that supply of the liquids to the respective chambers will result in those liquids, if under sufficient pressure, being discharged from the chambers, into the bore, as liquid jets. This discharge will generate a reduction of pressure in an upstream region of the bore, such as adjacent to the inlet, enabling the entrained particulate material and its carrier fluid to be drawn into the inlet end of the housing and then along the bore to the outlet end.

Where each of first and second fluids is a gas, the device again can be used to achieve mixing and/or reaction between the fluids. However, with use of a gas for each fluid, the device also is suitable for pumping a particulate material entrained in a carrier fluid, preferably a carrier gas, with the material being drawn into the bore via the inlet end. Of course, the device disclosed in the above-mentioned Australian patent 607079 provides a pumping action of a similar nature. However, the device of the present invention, when used for this purpose, enables operation with different first and second gases, enabling one to be used solely as a driving gas for providing a pumping action and the other gas to be used, at least in part, as a treatment gas for the particulate material. Thus, for example, the one gas may be air while, for example, the other gas may be a fumigant for treating particulate material such as grain, or reactant or treatment gas for reacting with, modifying or otherwise interacting with a particulate material such as alumina or another mineral species. Also, the device of the invention enables rapid absorption of a gas into some particulate materials. In particular, the device may be used in conventional scrubbing applications such as for instance in the treatment of smokestack effluent to remove particles therefrom.

For such pumping, using first and second gases, the lines for the passages of each set may converge as detailed above for mixing. However, for pumping, it is desirable that the lines for at least one set of passages are inclined transversely with respect to the axis. It can be beneficial to have the lines for the passages of each set transversely inclined with respect to the bore axis and, where this is the case, the inclination may be in the same direction, or in opposite or alternate directions.

The device of the invention also can be used with respective fluids comprising a liquid and a gas, such as to achieve mixing and/or reaction between these fluids. In this context, the device is suitable for pumping a particulate material entrained in a carrier fluid, preferably a carrier gas, with the material being drawn into the bore via the inlet end. A suitable example of this is in pumping particulate material such as fly-ash, such as into a land-fill site. In that example, fly-ash entrained in air can be pumped, under the driving action of a fluid comprising air, with the fly-ash being mixed with a fluid comprising water, preferably at or beyond the outlet end of the housing. With some particulate materials, such as fly-ash, to be mixed with a fluid, extreme difficulties are encountered with known procedures in achieving wetting of the material. However, with the device of the present invention, efficient wetting is able to be achieved by drawing the material into the inlet end of the bore so as to be mixed with liquid from the first chamber, or in liquid supplied to the inlet port of a first chamber, with the resultant mixture then being acted on by liquid from the second chamber. This is particularly the case where, due to transverse inclination of the passages for at least one chamber, preferably opposite respective transverse inclination for the passage of each chamber, the mixture is subjected to shear force.

The device can be used to scrub or strip constituents from a liquid by means of a gas. In one arrangement, the gas can be at least partially drawn into the bore from the inlet end, with the liquid passing to the bore via the passages for at least one chamber. Preferably the gas at least partially passes into the bore via the passages for a chamber, whether this is upstream from or downstream of the chamber providing the liquid. Where the gas is oxygen containing, it can for example be used to strip iron from at least some forms of iron-containing solutions, or it can strip ammonia from aqueous solutions. Again, it is desirable that the passages for each chamber have a degree of transverse inclination to generate shear force in the liquid and resultant intimate contact between the liquid and gas. Alternatively, the device can be used to achieve efficient absorption of a gas into a liquid for a variety of purposes, whether simply to achieve absorption or to achieve a reaction between the gas and a constituent of the liquid.

In most uses, the fluid discharging into the bore via the passages for the second, third or second and third chambers provides a driving action for the mixing, reacting and/or pumping. Also, the fluids from the chambers may flow from the housing into a conduit of the device, or connected to the housing, and providing a continuation of the bore beyond the outlet end. However, in the case of a material such as fly-ash which tends to stick to surfaces when wet, it is preferred that such conduit not be present and that the material is wetted at or beyond the outlet end of the housing. To achieve this, in pumping such material, a first fluid discharging into the bore via the passages for the first chamber preferably provides the driving action, with the fluid from the second and any third chamber mixing with the first fluid and entrained material at or beyond the outlet end.

Where the respective fluids comprise a liquid and a gas, the lines of the passages may converge as detailed above for mixing. However, it is desirable that the lines for at least one set of passages, preferably the or each set for providing jets of the gas, are inclined transversely with respect to the axis.

As indicated above, the passages of each set communicate with the bore at respective axially spaced locations, with the location for the second and any third set intermediate that for the first and second set, respectively, and the outlet end of the bore. The positioning of the chambers is less important but, as a practical matter, they preferably are similarly axially spaced. The spacing between the axial locations can vary substantially, depending in part on the diameter of the bore as mentioned above, the number and cross-section of the passages of each set and the radial inclination of the lines for the passages. However, in general, it is desirable that the spacing is such that the lines for the passages of the first set converge to a region which is beyond the location at which the passages of the second set communicate with the bore and, if there is a third set, that the passages of the second set converge to a similar location beyond the location at which the passages for the third set communicate with the bore.

The number, angular spacing and cross-section of the passages of each set also can vary substantially, although the angular spacing between the passages of each set preferably is substantially uniform. Factors relevant to determination of the number, spacing and cross-section of the passages are the diameter of the bore, and the radial and any transverse inclination of lines for the passages. However, the passages may, for example, range from 0.5 to 25 mm in diameter, while the number of passages in each set may for example range from about 3 to 50 or more, such as from 25 to 50. At least in some applications, there may be more passages in the second set than in the first set.

In use of the device, the inlet ports are connected to a source, or respective source of pressurised fluid. That is, the one source may provide the supply of fluid, via respective supply lines from that source. Alternatively, each supply may be from a respective source of the same or a different fluid.

With connection of the inlet ports, the respective supply to the ports results in the flow of fluid into and around each chamber, and discharge of fluid into the bore from each chamber, via the respective set of passages. Each discharge of fluid into the bore is as a respective jet of fluid issuing from the outlet of each passage of the respective set, towards and beyond the outlet end.

The pressure of fluid discharging into the bore from at least one chamber provides a driving action for the device, by generating a reduction in pressure in a region of the bore upstream from the passage outlets from that chamber. The pressure for at least one chamber thus needs to be sufficient for this. The pressure of fluid discharge from the or each other chamber may be the same as that for the one chamber, although it may be less than that of the one chamber. In general, it is desirable that, if there are differences in discharge pressure from the second and/or third chamber, it exceeds that for the first chamber. However, in some instances, such as in pumping some particulate materials with a liquid and gas, the discharge pressure from the first chamber may exceed that for the second and/or third chamber.

When the device is used simply for mixing or reacting first and second fluids, without particulate material being drawn in via the inlet end of the housing, the inlet end may be located a short distance upstream from the location at which the first chamber communicates with the bore. In such case, mixing may occur by the first fluid being drawn into the second fluid, and by ambient air being drawn into the fluids via the inlet end of the bore, due to the reduction in pressure generated upstream from the fluid jets.

Where it is required to have particulate material drawn into the bore via its inlet end, this may be via an inlet conduit connected to the housing so as to communicate with the bore at the inlet end. A remote end of the conduit then is positioned to enable the particulate material to be drawn therein, such as from a hopper containing, or a fluidised bed of, the particulate material. Alternatively, the device may include such conduit, with the conduit providing a continuation of the bore and defining the inlet end. The device preferably has a rigid housing, with the bore or portion of the bore in the housing having a linear axis. Such conduit, whether connected to or forming part of the device, may be rigid or flexible, as required.

Similarly, an output from the device may simply issue from the outlet end of the housing, or via an outlet conduit connected to the housing or forming a part of the device. The outlet conduit also may be rigid or flexible.

In the device of the invention, the passages of each chamber preferably are substantially uniform in their cross-section, angular spacing between successive passages, inclination towards the bore axis and, where relevant, in their transverse inclination with respect to that axis. While this uniformity applies to the passages of any given chamber, it also may apply to each chamber. However, in the case of transverse inclination, this can be the same or different from one chamber to another. Also, the inlet port for each chamber preferably is somewhat tangential to the chamber to facilitate fluid flow around the chamber and, for a chamber with transversely inclined passages, this inclination is in the general direction of fluid flow in the respective chamber.

The inclination of passages towards the bore axis may be such that the bore for each passage is at a substantial acute angle, such as up to 25°. However, the angle preferably is from 10° to 20°, such as from about 13° to 17°, and most preferably is about 15°. Where the passages of a chamber are inclined transversely with respect to the bore axis, the maximum range for such angles usually should be less than the inclination towards the axis, although the angle of transverse inclination can be larger for a fluid comprising a gas than for one comprising a liquid. In general, the angle of transverse inclination need not exceed about 12°, and is preferably from about 2° to 7°.

Where the direction of transverse inclination is in opposite directions in successive chambers, such as clockwise for the passages of first and third chambers and anti-clockwise for the passages of the second chamber, it can be desirable to limit the angle of inclination in some circumstances. Use of the device of the present invention can generate a substantial level of hydraulic or pneumatic shear forces in fluids that are brought into contact in the bore. Where a fluid contains species which are sensitive to such forces, such as long chain polymeric molecules, it can be desirable to avoid a reversal of the angle of transverse inclination from one chamber to the next and/or to limit such angle if breaking down of those species is to be minimised. However, of course, there can be applications in which it is desirable that species be subjected to strong shear forces, in which case such angle reversal and/or a larger angle of transverse inclination can be beneficial.

DETAILED DESCRIPTION OF THE INVENTION

Reference now is directed to the accompanying drawings. In doing so it will be appreciated that that the following description of preferred embodiments of the present invention is not to restrict the generality of the above description. In the drawings.

Figure 1:
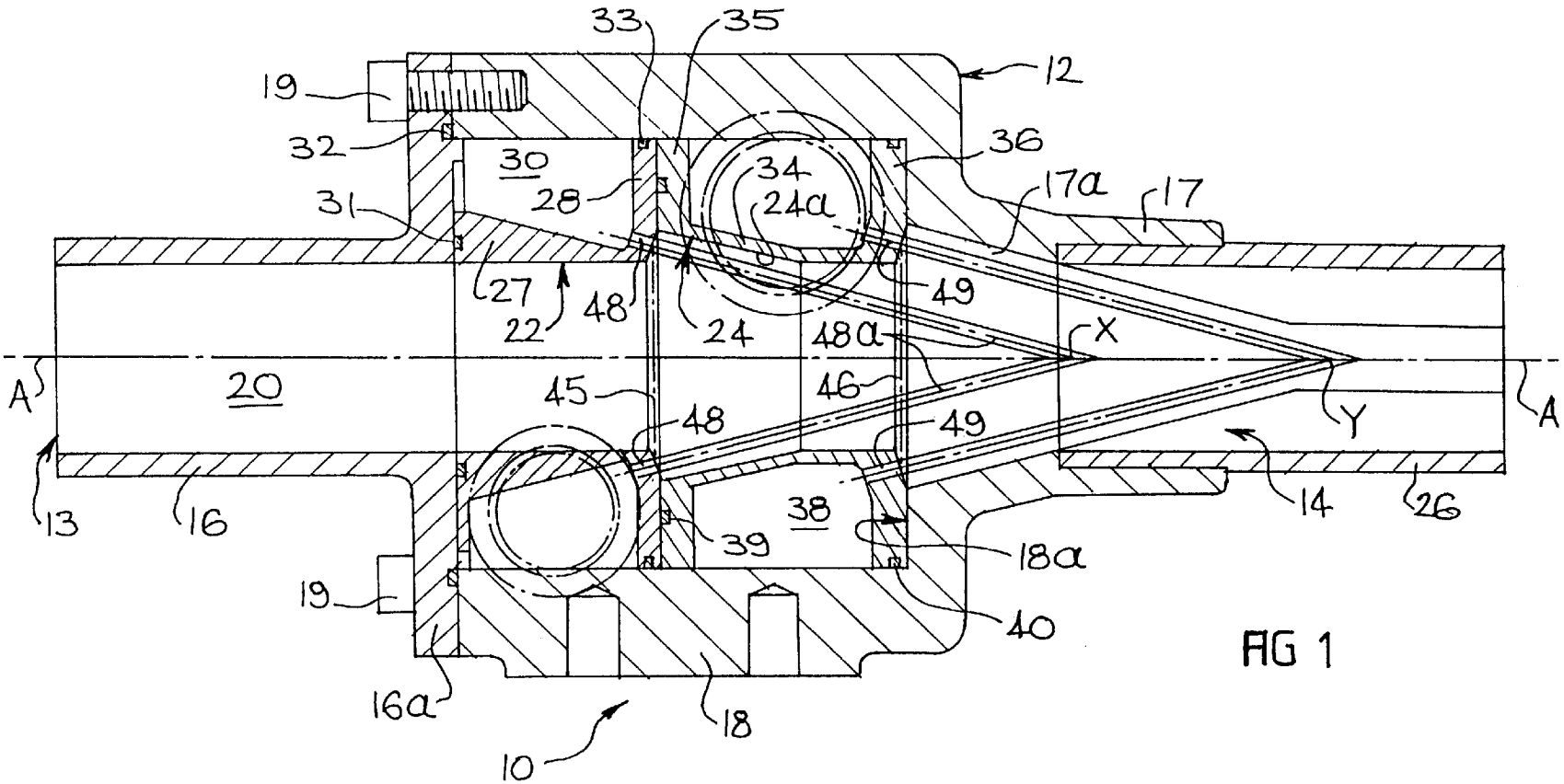
FIG. 1 shows a longitudinal sectional view of a device according to the invention, taken on line I—I of FIG. 2.
Figure 5A:
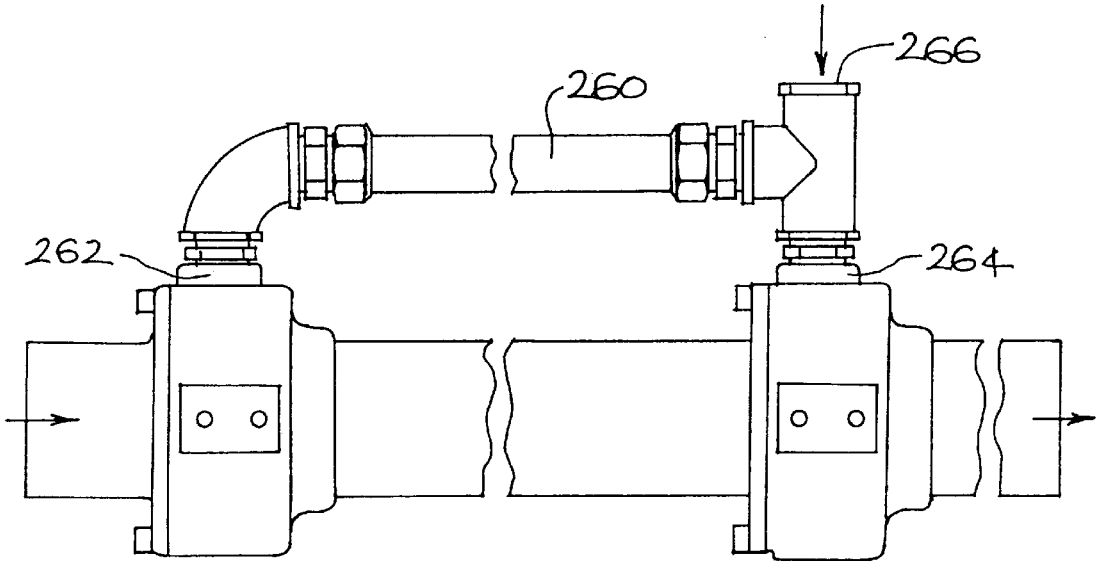
Figure 3:
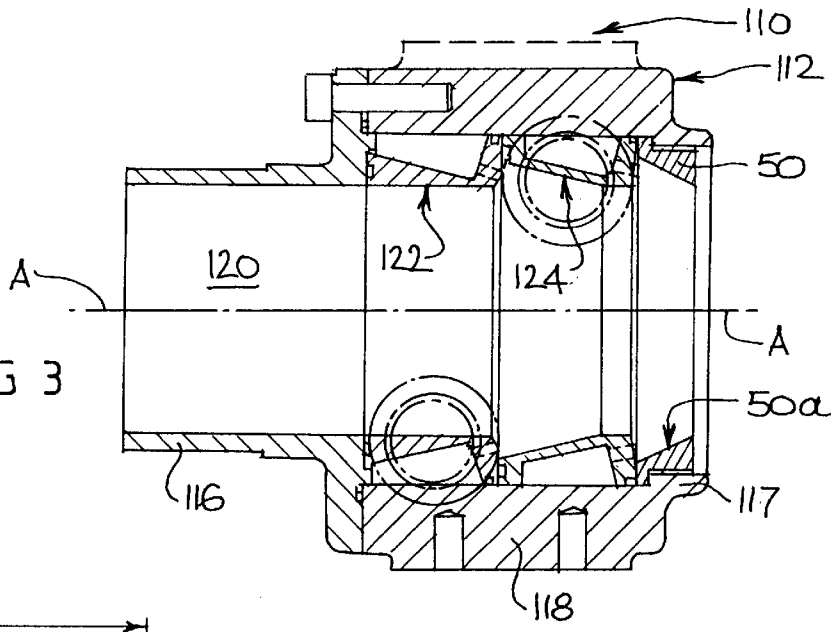
Figure 4:
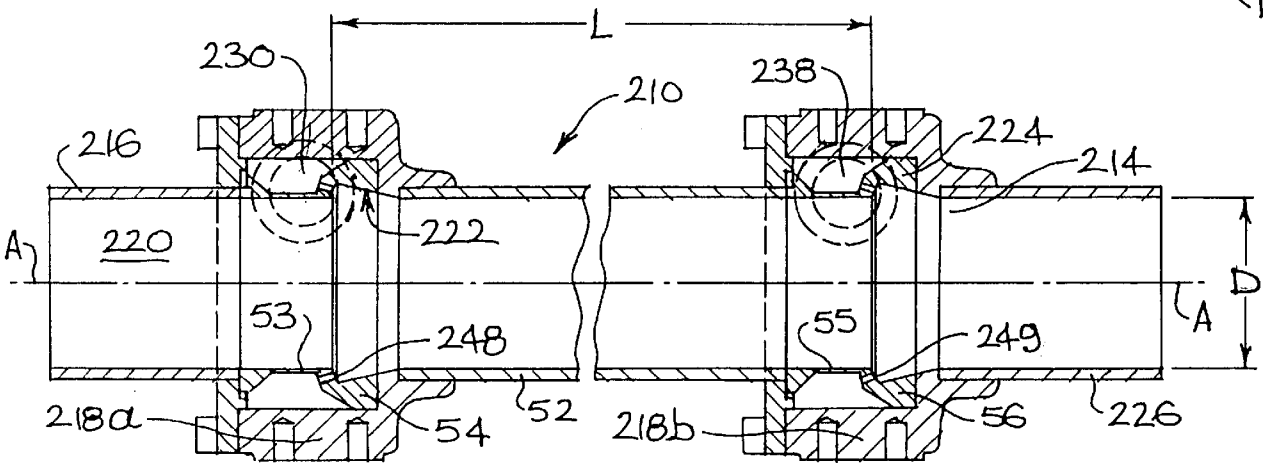
Figure 5B:
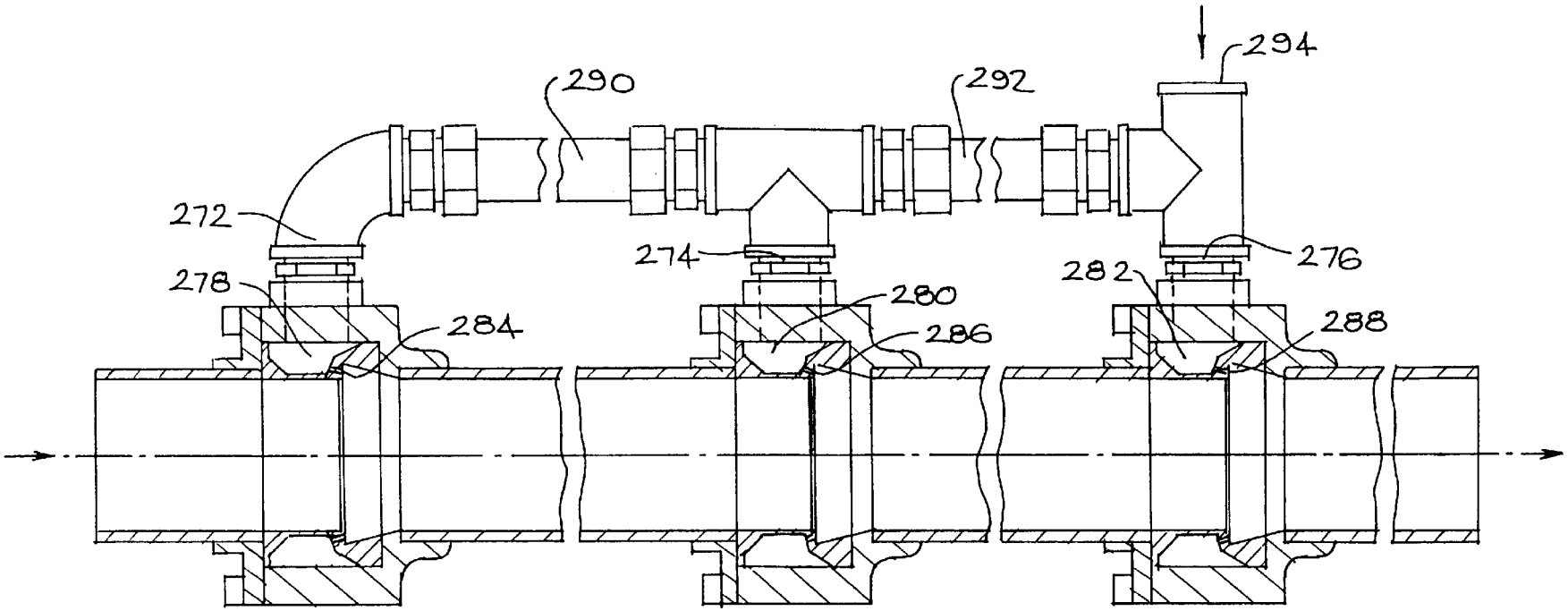
Figure 6A:
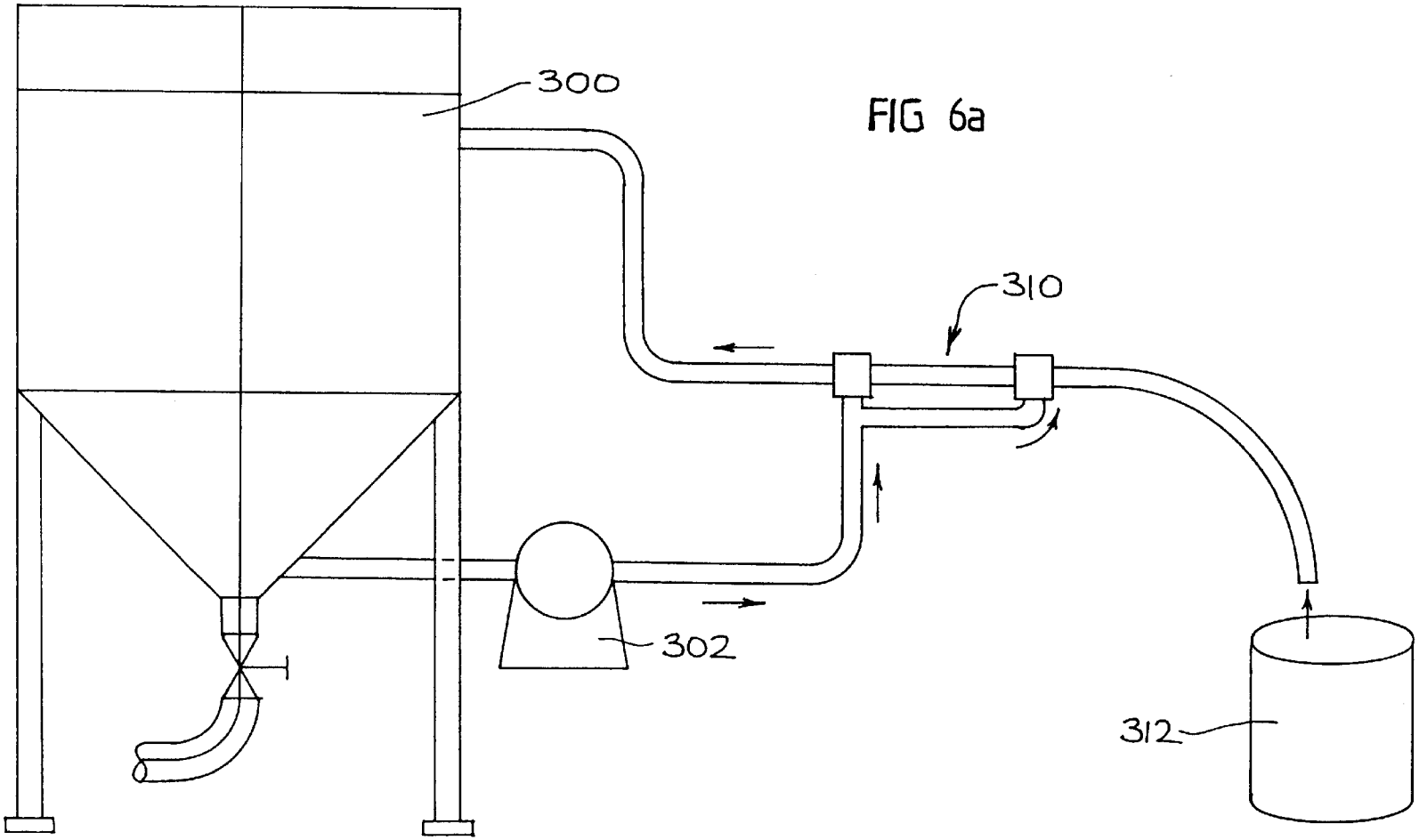
Figure 6B:
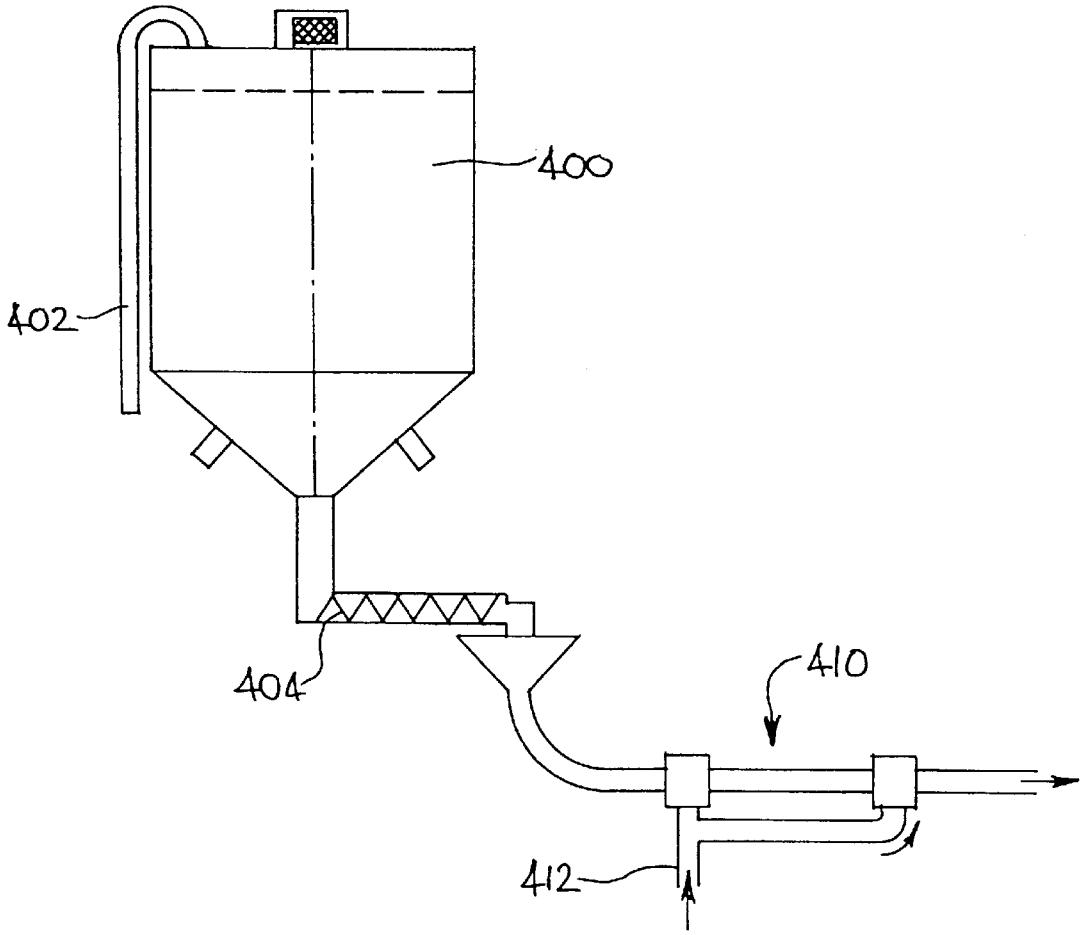
Figure 6C:
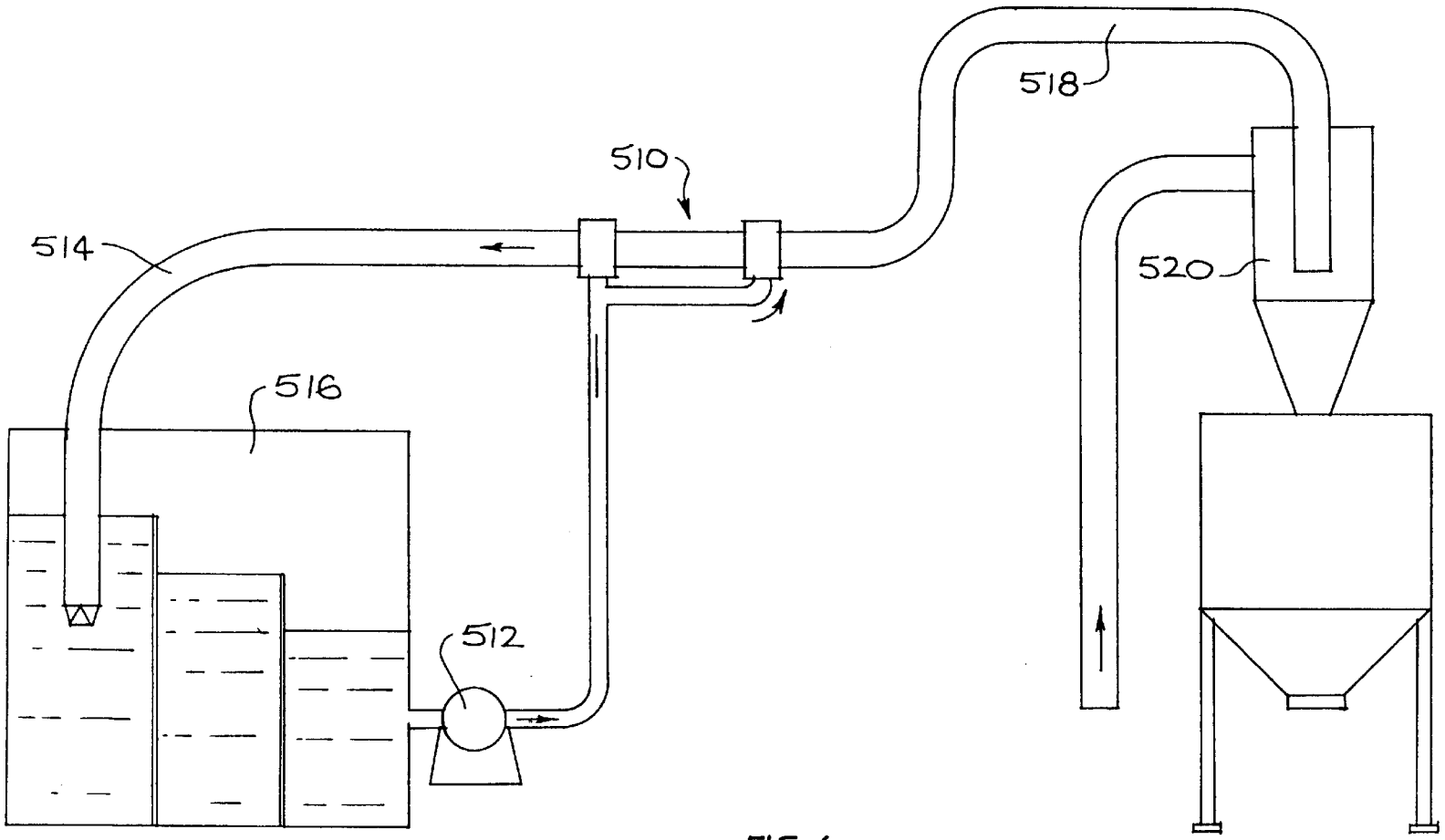

FIGS. 3 and 4 correspond to FIG. 1, but show respective alternative forms of the device;

FIGS. 5*a* and 5*b* are side schematic views of alternative forms of the device of the invention, additionally showing external interconnecting conduit; and FIGS. 6*a*, 6*b* and 6*c* are schematic representations of possible modes of use of the alternative form of the device shown in FIG. 5.

Figure 2:
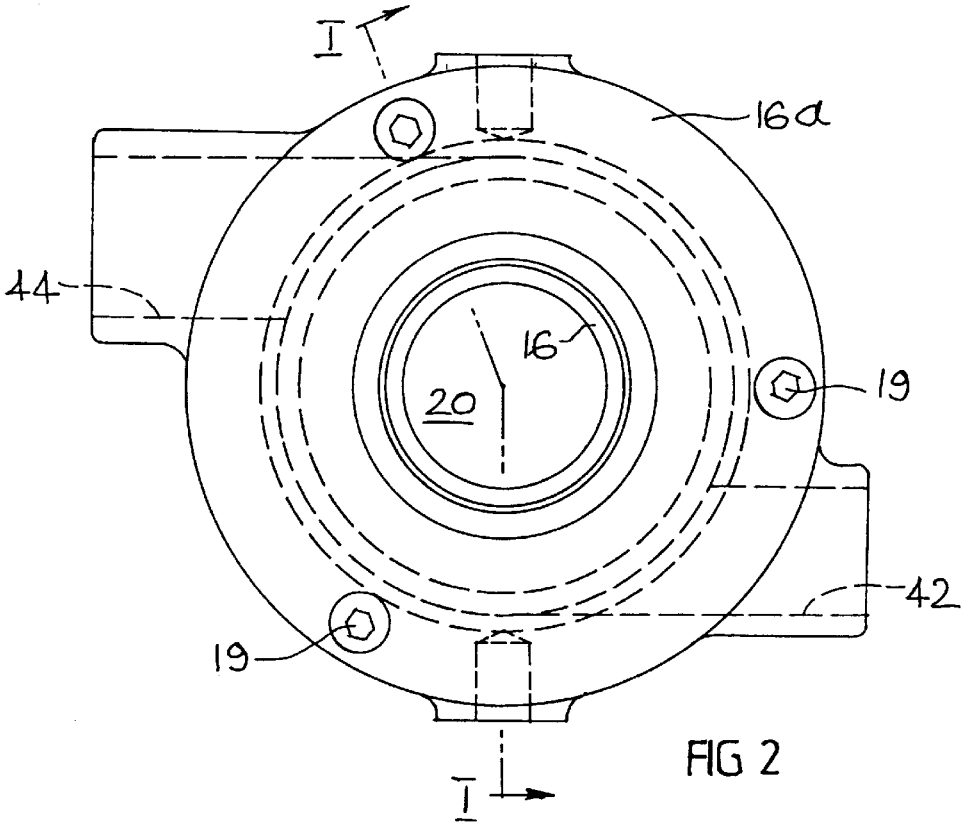
FIG. 2 shows an inlet end elevation of the device, as seen from the left side of FIG. 1.

The device 10 of FIGS. 1 and 2 includes a rigid housing 12, having an inlet end 13 and an outlet end 14. The housing 12 may be formed of metal or of a suitable plastics material.

The housing 12 is of cylindrical form and has an inlet portion 16 and an outlet portion 17, each of similar cross-section, and an enlarged central portion 18 which is integral with the outlet portion 17. At its end remote from the inlet end 13, the inlet portion 16 has a flange 16*a* by which it is connected to the open end of the central portion 18 by bolts 19.

Within the housing 12 there is defined a straight through bore 20 between the inlet and outlet ends (13, 14). The bore 20 is of uniform cross-section in the inlet portion 16. In the central portion 18, the bore 20 is defined by annular sub-housings 22 and 24 which are secured between the flange 16*a* and a shoulder 18*a* by which the central portion 18 merges with the outlet portion 17.

The portion of the bore 20 defined by the sub-housing 22 is of the same cross-section as in the inlet portion 16. However, the part of the bore 20 defined by the sub-housing 24 is enlarged at the junction of the two sub-housings (22, 24), as a result of a frusto-conical surface 24*a* of sub-housing 24, after which the bore 20 tapers inwardly towards the outlet end 14 to the same section as in the inlet portion 16. From the junction of sub-housing 24 and the shoulder 18*a* by which the central portion 18 merges with the outlet portion 17, the bore 20 again is enlarged by a frusto-conical surface 17*a* in the outlet portion 17, and similarly tapers back to the same section as in the inlet portion 16. The final extent of the bore 20 in the housing 12 is defined by a conduit 26 fitted into the outlet portion 17, and extending beyond the outlet end 14 over a required length. The conduit 26 may comprise a part of the device 10, or it may be connectable thereto.

The sub-housing 22 is of L-section, having a cylindrical part 27 that defines part of the bore 20, and a radially outwardly extending flange 28. It is fitted into the housing 12 to define, with the flange 16*a* and the outlet portion 17, an annular first chamber 30. Seals 31, 32 and 33 are provided as shown, to prevent fluid leakage from the first chamber 30.

The sub-housing 24 is of U-section, having a web-part 34 that defines part of the bore 20, and two radially outwardly extending flanges 35 and 36. The sub-housing 24 is fitted in the housing 12 to define with the outlet portion 17 an annular second chamber 38. Seals 39 and 40 are provided as shown to prevent fluid leakage from the second chamber 38.

The device 10 is connectable to a first supply of pressurised fluid by a first inlet port 42 communicating with the first chamber 30. The device 10 is also connectable to a second supply of pressurised fluid by a second inlet port 44, communicating with the second chamber 38.

The tapered surface 24*a* results in exposure of a shoulder 45 of the sub-housing 22 to the bore 20, while the tapered surface 17*a* similarly exposes a shoulder 46 of the sub-housing 24. Each of the shoulders 45 and 46 faces towards the outlet end 14 of the housing 12. The first chamber 30 is in communication with the bore 20 via a first set of circumferentially spaced passages 48, while the second chamber 38 is similarly in communication with the bore 20 via a second set of passages 49. Each passage in the first set of passages 48 extends through the shoulder 45 of the sub-housing 22, such that its outlet to the bore 20 is able to direct a respective jet of fluid supplied to the first chamber 30, along a line 48*a* inclined radially towards axis A—A of the bore 20, such that the lines 48*a* converge at region X. Each passage in the second set of passages 49 extends through the shoulder 46, such that its outlet to the bore 20 is able to direct a respective jet of fluid supplied to the second chamber 38, along a line 49*a* inclined radially to axis A—A, so the lines 49*a* converge at region Y.

Fluid supplied to the bore 20 from the second chamber 38 via the second set of passages 49, is to be at a pressure sufficient to generate a reduction of pressure in the bore 20 at an upstream location, at or towards the inlet end 13. The fluid supplied to the first chamber 30 may be at a similar or lesser pressure. The fluid jets generate a strong fluid flow towards and beyond the outlet end 14. Also, the reduced pressure at or towards the inlet end 13 enables a fluid, such as one containing entrained particulate material, to be drawn into and along the bore 20, via the inlet end 13. If required, a further conduit similar to conduit 26 can be fitted to the housing 12 at the inlet end 13, and the further conduit may comprise part of the device 10 or be connectable thereto.

The device 110 of FIG. 3 is similar in most respects to the device 10 of FIGS. 1 and 2. Thus, corresponding parts have the same reference numerals plus 100, such that, for example, it includes portion 116, which with sub-housings 122 and 124 defines bore 120. Also, description is limited to matters of principal difference.

A first, minor difference is that the length of the portion 116 of the device 110 which defines part of the bore 120 is of lesser length than the portion 16 of device 10. However, this does not influence the overall functioning of the device 110. A more significant difference is that the device 110 has only a relatively short portion 117 beyond the central portion 118 of the housing 112, while the device 110 also does not include a conduit corresponding to conduit 26 of device 10. Also, within the portion 117, device 110 has secured therein a ring 50 which has a frusto-conical internal surface 50*a* which reduces in radius to the outlet end 114. The surface 50 corresponds to the surface 17*a* in device 10.

Otherwise, device 110 is mechanically similar to device 10. Also, device 110 is functionally similar to device 10. Device 110 is better suited for use in a situation in which there are longitudinal space constraints for a required bore diameter. More importantly, device 110 is well suited for use where particulate material is to be slurried with a liquid and the particulate material, like fly ash, tends to stick to surfaces.

The device 210 of FIG. 4 also is similar in many respects to the device 10 of FIGS. 1 and 2. Thus, corresponding parts have the same reference numerals, plus 200. Again, description is limited to matters of principal difference.

Relative to device 10, the principal difference is that the central portion 18 of device 10 is replaced by two housing portions 218*a* and 218*b* which are spaced by a central conduit 52.

The housing portion 218*a* contains a sub-housing 222 and a first chamber 230, while the housing portion 218*b* contains a sub-housing 224 and a second chamber 238. Thus, fluid discharging from the first chamber 230 via the first set of passages 248 passes into the conduit 52, and thereafter along the bore 220 to the outlet 214 and the conduit 226. Similarly, fluid discharging from the second chamber 238 via the second set of passages 249 passes through the outlet 214 into the conduit 226, and mixing of the fluid occurs. Also, the sub-housing 222 is defined by a continuation 53 of the conduit 216 and by a ring 54 which defines the first set of passages 248, and the sub-housing 224 is defined by a continuation 55 of the conduit 52 and a ring 56 which defines the second set of passages 249.

With respect to the longitudinal spacing, and thus the length of the central conduit 52, it has been determined that beneficial results are most often gained when the distance L between the axial locations of the first and second sets of passages (248 and 249) is up to about seven times the diameter D of the bore 220.

In device 10 of FIGS. 1 and 2, the first and second sets of passages (48 and 49) are shown as extending along respective lines 48*a* and 49*a* converging on respective regions X and Y on axis A—A. The implication of this is that the passages extend such that each line is along a radial plane containing axis A—A, without any inclination of the passages (and hence the lines) transversely with respect to axis A—A. However, as detailed herein, this is but one option, since the passages of one or each of sub-housings 22 and 24 can in other options also be inclined transversely with respect to axis A—A. Also, where each set of passages are transversely inclined, this can be in the same direction or in opposite directions.

In each of the devices 10, 110 and 210, only two chambers are shown. However, as detailed herein, there can be at least one third chamber. Thus, in the case of device 10 and device 110, the respective housing portion 18 and 118 can be longitudinally extended to accommodate therein a further sub-housing similar to sub-housings 22, 24 and 122, 124. Alternatively, in the case of device 210, there are two broad forms of variation possible. In the first of these, the arrangement is somewhat similar to a combination of devices 112 and 210. That is, one of the housing portions 218*a* and 218*b* of device 210 can be longitudinally extended to accommodate a second sub-housing. In the second form of variation, a second conduit 52 may be provided after the housing portion 218*b*, and lead to a third sub-housing, with the outlet end being beyond the third sub-housing and possibly within a discharge conduit 226.

Where a third chamber is provided, the passages from it may be inclined towards the axis of the bore and open towards the outlet end, with or without transverse inclination with respect to the bore axis.

The dimensions of the device may vary substantially. Thus, in the case of the device 10 of FIGS. 1 and 2, the dimensions may be as follows:

| | |
|---|---|
| Inlet portion 16: | 0 to 300 mm long |
| Central portion 18: | 50 to 800 mm long |
| Central portion 19 I.D.: | 20 to 1,400 mm |
| Portion 17/conduit 26: | 50 mm to 20 m long |
| Bore 20 diameter: | 6 to 1,250 mm |
| Inlet ports 42, 44 I.D.: | 8 to 300 mm |

In the case of a device 210 as in FIG. 4, the overall situation may be similar. In the case of each of devices 10, 110 and 210, the dimensions generally increase somewhat proportionally in the respective ranges, although there can be departures from this for specific applications. Thus for example, in some applications, a device may have length dimensions towards the upper extent of the indicated ranges, although the bore diameter and inlet port sizes may be towards or at the lower end of their respective ranges.

The volume of the respective annular chambers, of course, increases with the dimensions of the central portion or portions in which they are contained and the bore diameter, but are dependent on the wall thickness of the respective sub-housings. However, generally, those volumes are related to the inlet port size and bore diameter. The number and cross-sectioned sizes of the passages for each chamber usually is similarly related. However, in the context of the above-indicated dimensional examples, the number and cross-sectional areas of the passages can vary substantially, given that it usually is possible to increase the number of passages by decreasing their cross-sections, and vice versa.

FIG. 5*a* illustrates the form of the device 210 as shown in FIG. 4, together with an interconnecting conduit 260 which enables the inlets 262 and 264 to the first and second chambers each to be connectable to a common source of pressurisable fluid via inlet point 226.

Similarly, FIG. 5*b* illustrates another form of the device 270 having three inlet ports 272, 274 and 276 associated with three chambers 278,280 and 282 and three sets of passages 284, 286 and 288, together with interconnecting conduits 290 and 292 which enable the inlets 272, 274 and 276 to the first, second and third chambers each to be connectable to a common source of pressurisable fluid via inlet point 294. In this form, and as referred to in the general text above, the three sets of passages 284, 286 and 288 are preferably transversely inclined to the axis of the bore, with the passages 284 and 288 inclined to create a clockwise flow and the passages 286 inclined in the opposite direction to create an anticlockwise flow.

The embodiment illustrated in FIG. 5*b* is particularly preferred for use in scrubbing operations, such as in the scrubbing of alumina and the like. Tests using three 100 mm nozzles each having four passages of about 2 mm diameter, with an outlet pipe of length 5080 mm, have shown excellent results for scrubbing. For instance, at a water pressure of 700 kPa a flowrate of 50 liters/min has been achieved, giving rise to a vacuum of 311 $mmH_2O$ with high flow-rate.

Referring back to the embodiment illustrated in FIG. 5*a,* this arrangement may be successfully adopted for use in the manufacture of, for instance, paint as shown in FIG. 6*a.* In FIG. 6*a,* a supply 300 of the base fluid of a paint is drawn via a pump 302 and is supplied under pressure to the device 310 of the present invention. As described above, the device 310 creates a vacuum to draw powders from ingredient bin 312, thoroughly mixing the powders into the liquid before returning product to the tank. A system such as this may similarly be applied to many applications and industries, such as in the mixing of starch and other chemicals, or the mixing of difficult to wet powders.

A different arrangement for use of the device of the present invention is illustrated in FIG. 6*b.* The arrangement in FIG. 6*b* is for use in mixing lime with water whilst minimising dust levels and thus safety difficulties. A lime hopper 400 is supplied with lime via line 402, itself supplying lime to the device 410 of the invention via a screw feeder 404. Water is supplied under pressure via line 412 to the device 410 and the lime and water mix exits via outlet 414.

The device of the present invention has also been found to be capable of generating very high vacuums and flow-rates, up to −100 kPa using water up to 700 kPa, and can thus be used as a dry vacuum system or as a vacuum generator. For instance, tests using 25 mm nozzles each having four passages of diameter of about 4 mm and an outlet tube of length of 220 mm, gave the following results (for water flow at 700 kPa of 192 liters/min):

| Water Pressure (kPa) | Vacuum (−kPa) |
|---|---|
| 200 | 32 |
| 300 | 51 |
| 400 | 70 |
| 500 | 89 |
| 600 | 100 |

Further tests using 50 mm nozzles, each having six passages of diameter of about 7 mm and having an outlet tube of length of 800 mm, gave the following results (for water flow at 700 kPa of 700 liters/min):

| Water Pressure (kPa) | Vacuum (−kPa) |
|---|---|
| 100 | 18 |
| 200 | 42 |
| 300 | 66 |
| 400 | 88 |
| 500 | 100 |

Such an arrangement may be used for instance in dry suction situations, an example of which is illustrated in FIG. 6*c.* In FIG. 6*c* there is illustrated a device 510 in accordance with a preferred embodiment of the present invention which recycles water therethrough via a pump 512, a return line 514 and a water tank 516, to provide suction at high vacuum via a line 518 for use in a cyclone 520 or the like.

Other possible uses for arrangement such as those illustrated in the various forms of FIG. 6 are:

1. Mixing yeast and salt into soy sauce—yeast dust is potentially carcinogenic and is thus dangerous to handle and mix. In the present invention it can be directly sucked into the device and incorporated in the liquid without risk of atmospheric dispersal;
2. Ammonium nitrate and diesel—such a mixture is dangerous and it is safer for an underground mine site, for example, to mix on-site rather than transport the mixture;
3. Diatomaceous earth and kerosene—as for the yeast mentioned above, the kerosene is used as a lubricant in cold rolling aluminium foil, while the diatomaceous earth takes up aluminium dust;
4. Flocculants and water—mixing of long chain polymer flocculants with high shear and without risk of chain rupture such as would occur with impellers. For example, the mixing of flocculent MAG338 (Allied Colloids), an acrylic polymer for use in the paper industry;
5. Encapsulating radioactive waste with epoxy resins such as by using a two-resin mix;
6. Coating alumina with a rare gas—by effectively "purifying" a smelting grade alumina (for instance) by flushing any volatiles such as halides;
7. Oxidising material while converging—together with other in situ reactions in fluid—fluid or fluid-solid (particulate) systems;
8. Starch and water—mixing of difficult to wet powders such as starch (and fly-ash) is facilitated.

Finally, it is to be understood that various alterations, modifications and/or additions may be introduced into the constructions and arrangements of parts previously described without departing from the spirit or ambit of the invention.

What is claimed is:

1. A fluid handling device, the device having:

an elongate tubular body which defines a through bore between an inlet end and an outlet end of the body;

first and second annular chambers, each of which extends substantially concentrically around the bore, the first chamber being in communication with the bore via a first set of passages spaced circumferentially around the bore, and the second chamber being in communication with the bore via a second set of passages spaced circumferentially around the bore, the passages of each set communicating with the bore at a respective axial location intermediate the ends of the bore, with the location for the second set between the location for the first set and the outlet end of the housing, and each passage of each set having an opening into the bore which faces towards the outlet end of the body;

a first inlet port by which the first chamber is connectable to a source of pressurised fluid; and a second inlet port by which the second chamber is connectable to a source of pressurised fluid;

wherein the passages of each set are both:

(i) inclined radially towards the axis of the bore, and (ii) inclined transversely with respect to the axis of the bore, along respective lines whereby the lines for passages of the first set converge along the bore towards the outlet end to a first region, and the lines for passages of the second set converge to a second region beyond the first region. and wherein the passages of the second set are inclined transversely with respect to the axis of the bore in the opposite direction to the direction of transverse inclination of the passages of the first set.

2. A fluid handling device according to claim 1, including a third annular chamber which extends substantially concentrically around the bore and is in communication with the bore via a third set of passages spaced circumferentially around the bore at an axial location between the axial location for the second set and the outlet end of the bore, wherein the passages of the third set are both:

(i) inclined radially towards the axis of the bore, and (ii) inclined transversely with respect to the axis of the bore, along respective lines which converge along the bore to a third region beyond the second region and wherein the transverse inclination of the passages of the third set with respect to the axis of the bore is in the same direction as the passages of the first set.

3. A fluid handling device according to claim 2 including a third port by which the third chamber is connectable to a source of pressurised fluid.

4. A fluid handling device according to claim 2, wherein the axial locations of the second and third sets of passages are longitudinally spaced by a conduit which provides a continuation of the bore between the locations.

5. A fluid handling device according to claim 1 wherein the angle of transverse inclination is up to 12°.

6. A fluid handling device according to claim 5 wherein the angle of transverse inclination is in the range of from 2° to 7°.

7. A fluid handling device according to claim 1, wherein the axial locations of the first and second sets of passages are longitudinally spaced by a conduit which provides a continuation of the bore between the locations.

8. A fluid handling device according to claim 7 wherein the longitudinal spacing is up to about seven times the diameter of the bore.

9. A fluid handling device according to claim 8 wherein the longitudinal spacing is in the range of from 2 to 5 times the diameter of the bore.

10. A fluid handling device according to claim 1 wherein the first and second inlet ports are connectable to a respective source of pressurised fluid.

11. A fluid handling device according to claim 1 wherein the first and second inlet ports are interconnected by a conduit to enable each to be connectable to a common source of pressurisable fluid.

12. A fluid handling device according to claim 1 wherein the pressure of fluid discharge from the second chamber is greater than the pressure of fluid discharge from the first chamber.

13. A fluid handling device according to claim 1 wherein the inclination of passages towards the bore axis is up to 25°.

14. A fluid handling device according to claim 13 wherein the inclination of passages towards the bore axis is in the range of from 13° to 17°.

15. A fluid handling device, the device having:

an elongate tubular body which defines a through bore between an inlet end and an outlet end of the body;

first and second annular chambers, each of which extends substantially concentrically around the bore, the first chamber being in communication with the bore via a first set of passages spaced circumferentially around the bore, and the second chamber being in communication with the bore via a second set of passages spaced circumferentially around the bore, the passages of each set communicating with the bore at a respective axial location intermediate the ends of the bore, with the location for the second set between the location for the first set and the outlet end of the housing, and each passage of each set having an opening into the bore which faces towards the outlet end of the body;

a first inlet port by which the first chamber is connectable to a source of pressurised fluid; and a second inlet port by which the second chamber is connectable to a source of pressurised fluid; wherein the passages of each set are inclined radially towards the axis of the bore along respective lines such that the lines for passages of the first set converge along the bore to a first region towards, at or beyond the outlet end, and the lines for passages of the second set converge to a second region beyond the first region;

the first set of passages is inclined transversely with respect to the axis of the bore, and the second set of passages is also inclined transversely with respect to the axis of the bore, but in the opposite direction; and the axial locations of the first and second sets of passages are longitudinally spaced by a conduit which provides a continuation of the bore between the locations.

* * * * *